US005177927A

United States Patent [19]

Goya et al.

[11] Patent Number: 5,177,927

[45] Date of Patent: Jan. 12, 1993

[54] METAL CONNECTORS FOR BUILDING

[76] Inventors: Shigeo Goya, 27-1, Kumoji 3-chome, Naha-shi, Okinawa-ken; Takao Hirata, 30, Aza-yabiku, Sashiki-cho, Shimajiri-gun, Okinawa-ken, both of Japan

[21] Appl. No.: 740,588

[22] Filed: Aug. 5, 1991

[30] Foreign Application Priority Data

Aug. 9, 1990 [JP] Japan ..... 2-209295

[51] Int. Cl.[5] ..... E04H 5/08

[52] U.S. Cl. ..... 52/696; 52/90; 403/272; 403/389

[58] Field of Search ..... 52/696, 90, 690; 403/277, 280, 248, 389, 391

[56] References Cited

U.S. PATENT DOCUMENTS

| | | | |
|---|---|---|---|
| 1,112,258 | 9/1914 | Burton | 403/277 |
| 2,106,724 | 2/1938 | Cope | 403/280 |
| 3,840,124 | 10/1974 | Atwater | 52/696 |
| 4,294,051 | 10/1981 | Hughes, Jr. | 52/90 |
| 4,309,857 | 1/1982 | Lovering | 52/90 |

*Primary Examiner*—David A. Scherbel
*Assistant Examiner*—Joanne C. Downs
*Attorney, Agent, or Firm*—Kanesaka and Takeuchi

[57] ABSTRACT

A metal connector for a building includes a pipe-shaped frame having a plurality of axial slits at its both ends, a wedge member fitted at each end of the frame, and a connecting member directly passed through the frame or passed through a box-shaped anchor loosely fitted over the outer periphery of the frame. The wedge member is fitted to each end of the frame to secure the frame to a wooden member, while neighboring wooden members are joined together by the connecting member.

8 Claims, 4 Drawing Sheets

10
11
12
20
30
31
40
40(40a)
40(40b)
41
42

METAL CONNECTORS FOR BUILDING

BACKGROUND OF THE INVENTION

1. Field of the Invention

This invention relates to a metal connector for wooden members in a wooden building and more particularly to a metal connector for a wooden building advantageously employed in a wood frame construction system.

2. Related Art

Recently, a wood frame construction system, in which a plywood for structural use is lined over a frame composed of timbers and a so-formed panel is used as a durable wall. With this construction system, connection of a ridge to a roof truss or of a roof truss to a double plate is performed on the construction site by connecting associated wooden members by metal connectors by a manual operation of an operator. When assembling a roof, for example, the forward ends of a set of roof truss is placed in opposition to those of another set of roof truss with a ridge in-between and the roof truss sets are connected to each other and to the ridge under this condition by metal connectors. This operation is repeated for each of a number of roof truss sets facing each other.

Since the connection of the ridge to the roof truss and that of the roof truss to the double plate in the conventional wood frame construction system is performed in this manner from one roof truss set to another at a poorly supported elevated position on the construction site, problems are presented in safety and operational efficiency.

SUMMARY OF THE INVENTION

Object of the Invention

It is an object of the present invention to provide a metal connector for buildings by means of which a number of roof truss members are preassembled into a roof truss unit in a plant where the working environment is more benign and a number of such roof truss units are simply joined together on the construction site to construct a wooden building.

Feature of the Invention

The metal connector for buildings according to the present invention includes a pipe-shaped frame having a plurality of axial slits at its both ends, a wedge member fitted at each end of the frame and a connecting member directly passed through the frame or through a box-shaped anchor loosely fitted over the outer periphery of the frame. An elongated bolt or a strap bolt is employed as the connecting member.

With the metal connector for a building, a number of operations conventionally performed at the construction site may be performed at the plant where the working environment is more favorable, thereby improving safety and the working efficiency. The building constructed with the use of the metal connector according to the present invention exhibits improved durability against collapse due to strong winds or vibrations due to earthquakes.

Other objects and features of the present invention will become more apparent from the following description.

BRIEF DESCRIPTION OF THE DRAWINGS

The drawings illustrate the present invention, wherein.

DESCRIPTION OF THE PREFERRED EMBODIMENTS

Figures 1, 2:
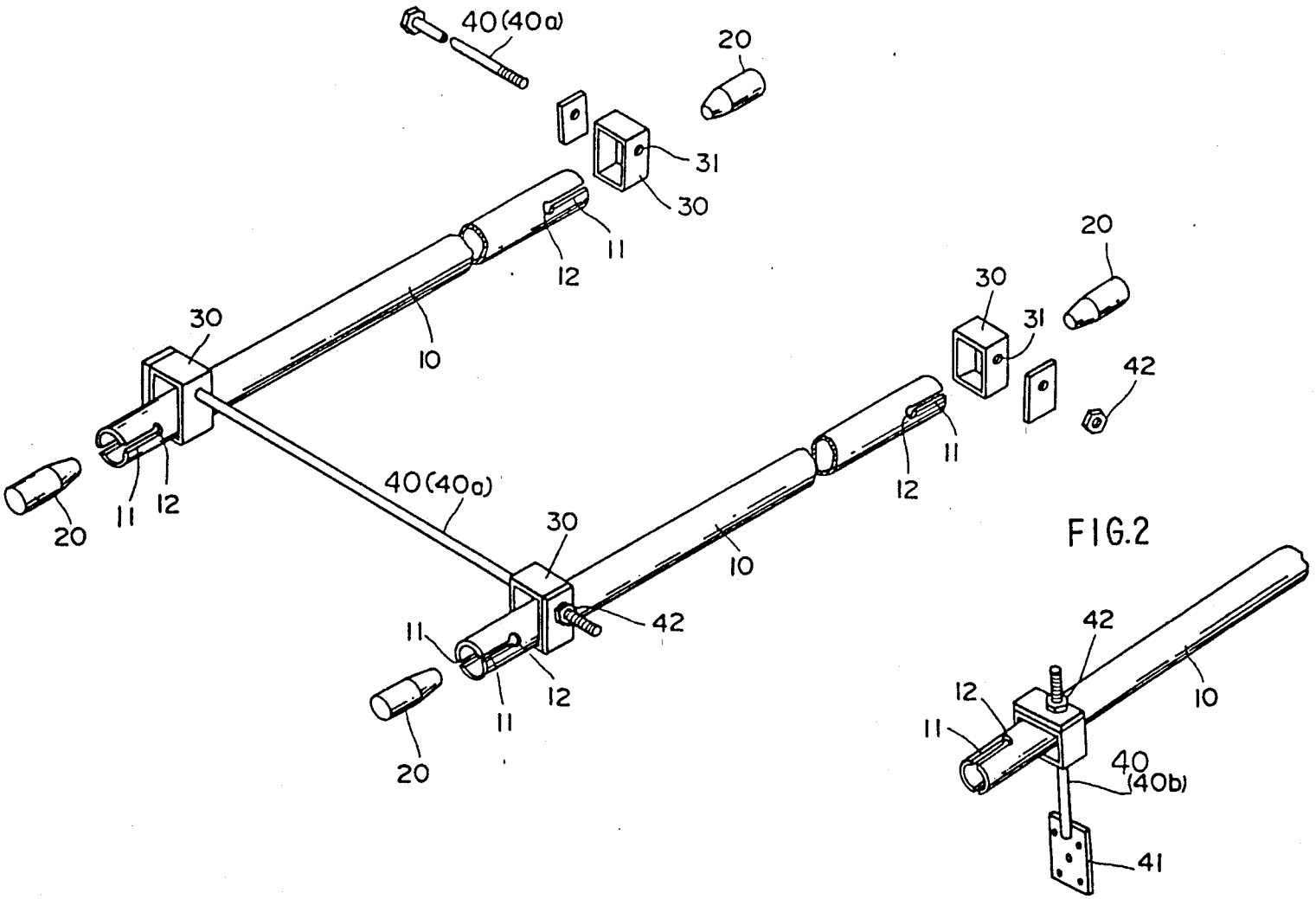
FIG. 1 is a perspective view showing a first embodiment of the invention, with a portion thereof not being shown.
FIG. 2 is a perspective view showing a second embodiment of the invention, with a portion thereof not being shown.

By referring to the drawings, illustrative embodiments of a metal connector according to the present invention will be explained in detail.

FIG. 1 is a perspective view of a first embodiment of the present invention, with a portion thereof not being shown.

A frame 10 is designed as an elongated pipe. The length of the frame 10 depends on the number of roof truss members to be arranged in a roof truss set, as will be explained hereinbelow. Slits 11 are provided for extending at both ends and along the axis of each frame 10 for facilitating spreading apart both ends of the frame 10. Two to eight slits 11 are usually provided (two in the present embodiment) and a small aperture 12 is formed at the inner end of each slit 11. The function of the apertures 12 is to render both ends of the frame 10 spreadable with greater ease.

A wedge member 20 is tapered at its distal end and is fitted into each end of the frame 10 formed with slits 11 to spread the end of the frame 10 apart.

A box-shaped anchor 30 has a hollow interior having a cross-sectional area larger than the radial cross sectional area of the frame 10 and is fitted loosely over the outer peripheral surface of the frame 10. In the present embodiment, the box-shaped anchor 30 is square in profile and has registering through-holes 31 on the opposite sides thereof through which is passed an elongated bolt **40*a* as a connecting member 40. These through-holes 31 are provided at such positions in the aforementioned opposite sides that the frame 10 and the elongated bolt 40*a* are not in conflict with each other when the box-shaped anchor 30 is loosely fitted over the frame 10 and the elongated bolt 40** a is passed through the anchor.

It is noted that the box-shaped anchor 30 may also be oval or in the shape of a key-hole instead of being square in shape.

With the above described metal connector of the first embodiment, two of the frames 10, four of the box-shaped anchors 30 and two of the bolts 40 are used for interconnecting roof truss members placed on both sides of a ridge, that is for interconnecting the roof truss members, ridge and roof truss members, in this order, as will be explained subsequently.

It is noted that the connecting metal fittings of the first embodiment may also be employed for interconnecting a floor framing of the second floor and upper and lower studs.

FIG. 2 shows a second embodiment of the present invention. This metal connector for a building is a metal fitting employed for interconnecting the roof truss and a double plate or a stud or interconnecting the roof truss and a tie beam and is similar in structure to the first embodiment except as to the connecting member 40. That is, with the present metal connector, a strap bolt 40*b* comprised of a bolt and a fixture plate 41 provided to the end of the bolt is used as the connecting member.

Connection of a roof truss to a ridge, connection of a roof truss to a double plate and connection of a roof truss and a stud to a tie beam with the use of metal connector of the first embodiment and a metal connector of the second embodiment, will be hereinafter explained.

Figure 3:
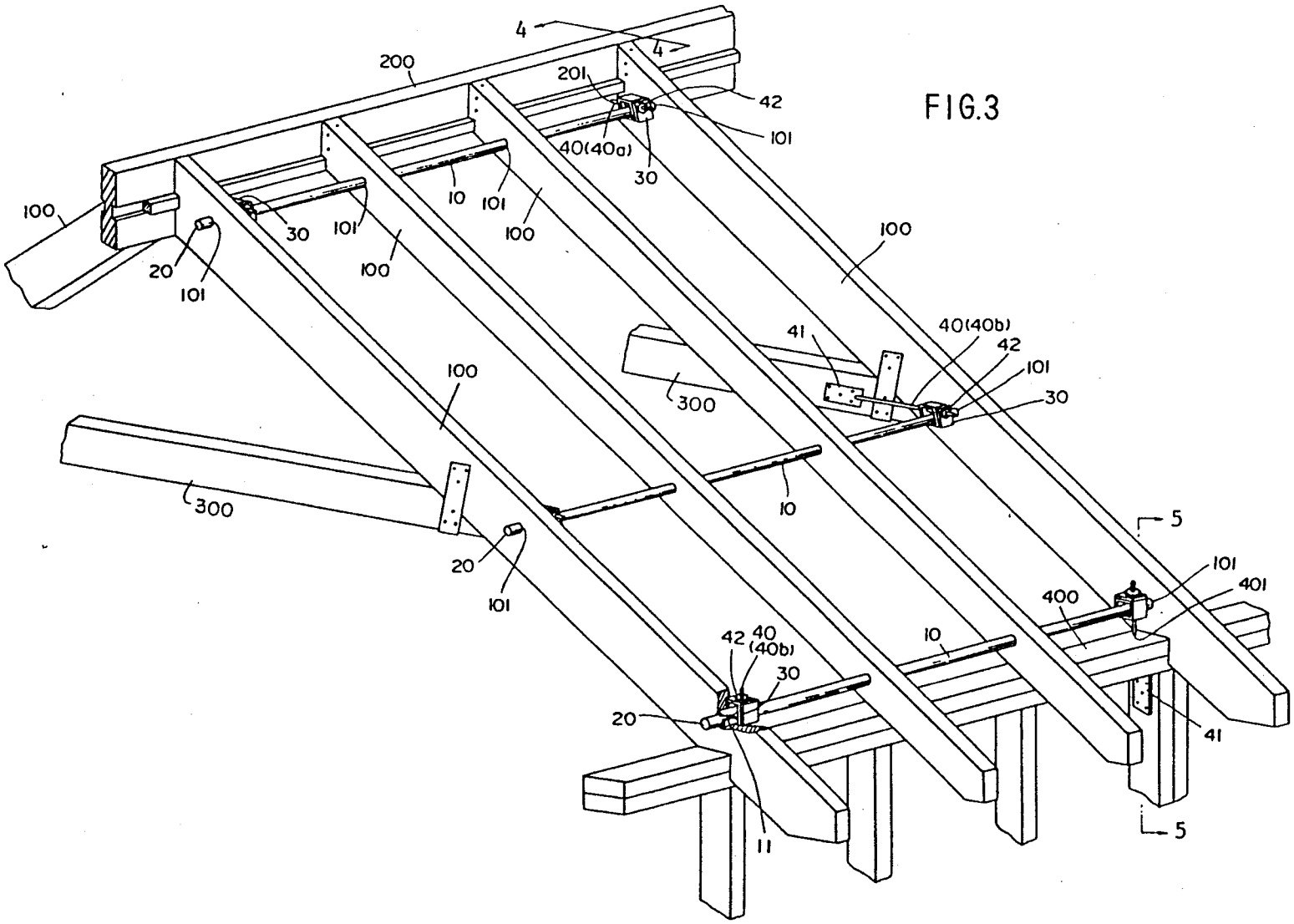
FIG. 3 is a perspective view showing the state in which wooden members are joined together by using metal connectors of both the first and second embodiments.
Figure 4:
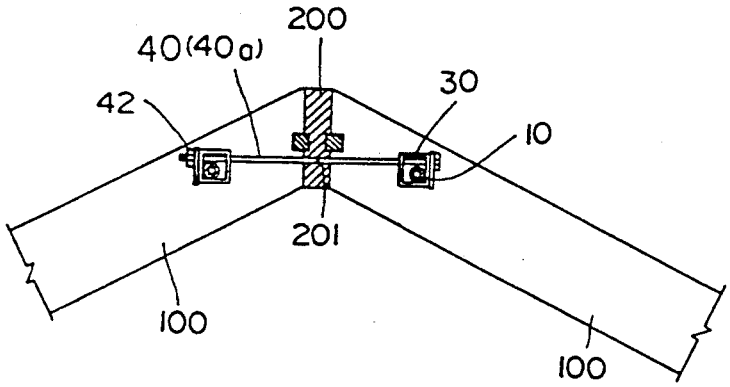
FIG. 4 is a cross-sectional view taken along line 4–4 in FIG. 3.
Figure 5:
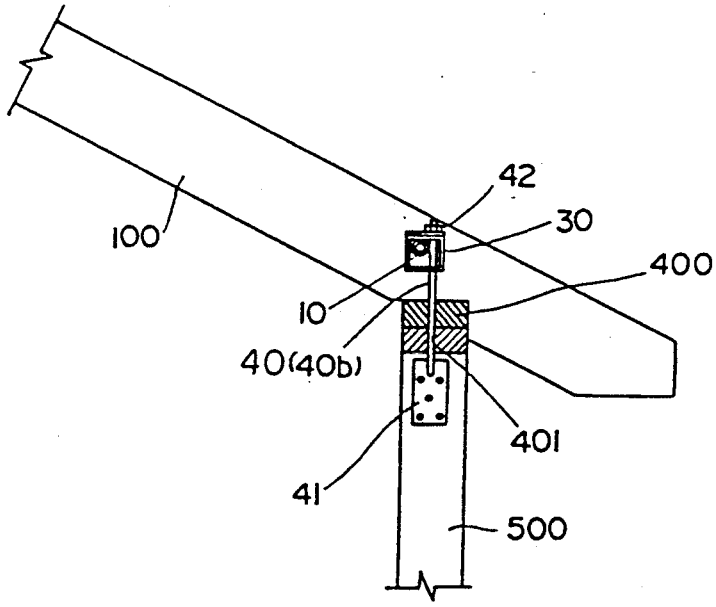
FIG. 5 is a cross-sectional view taken along line 5—5 in FIG. 3

FIG. 3 is a perspective view showing the state of connecting wooden members with the use of the metal connector, FIG. 4 is a cross-sectional view taken along line 4—4 of FIG. 3 and FIG. 5 is a cross-sectional view taken along line 5—5 of FIG. 3.

In these figures, there is shown a roof truss member 100, a ridge 200, a tie beam 300, a double plate 400 and a stud 500.

With the metal connector of the first embodiment, a frame 10 is passed through holes 101 formed at the distal ends of four juxtaposed roof trus members 100. Box-shaped anchors 30 are previously passed loosely frame 10 so as to be disposed between adjoining roof truss members 100. Both ends of the frame 10 are so disposed that the slits 11 are not protruded excessively from the sides of the roof truss 100.

In this state, wedge members 20 are driven into both ends of the frame 10 for extending the ends of the frame 10 into pressure fitting onto the inner peripheral surface of the hole 101 of each roof truss member 100. In this manner, both ends of the frame 10 are secured to both end roof truss members 100.

In a similar manner, two frames 10 having box-shaped anchors 30 loosely fitted thereon are secured to holes 101 formed at the middle and at rear sides of the four roof truss members 100.

When the four roof truss members 100 are secured together by frames 10 at the foremost sides, at the middle and at the rear sides of the four roof truss members 100, the four roof truss members 100 are assembled together as a roof truss unit. The assembling of the roof truss members into a roof truss unit may be carried out at a plant having of the roof truss members 100 constituting one roof truss unit is not limited to four.

Two of the so-assembled roof truss units are placed on both sides of a ridge 200. An elongated bolt 40*a* is introduced from one of through-holes 31 of each of box-shaped anchors 30 placed on both sides of the ridge 200. This elongated bolt 40*a* is passed through the through-holes 31, an aperture 201 in the ridge 200 and through-holes 31 in the other box-shaped anchor 30, and is secured in position by nuts 42 (FIG. 4). When the bolt 40*a* is passed in this manner, the box-shaped anchor 30 is moved freely along the length of the frame 10 on its periphery, so that position matching of the box-shaped anchor 30 with respect to the through-holes 31 and the aperture 200 in the ridge 200 may be achieved easily to facilitate the operation of passing the bolt 40*a*.

A plurality of roof truss units, each comprised of roof truss members 100 arranged on both sides of the ridge 200, are joined together to complete a roof truss assembly. It is noted that, if a crane or the like equipment is available on the construction site, the process step until completion of the roof truss assembly may be performed at the plant and only the process step of installing the roof truss assembly in place may performed on the construction site using the crane.

The roof truss and the tie beam 300 may be joined together using a strap bolt 40*b*. That is, the strap bolt 40*b* is introduced into the through-holes 31 of the box-shaped anchor 30 loosely fitted on the frame 10 secured at the middle of the roof truss member 30 and secured with a nut 42, while the fixture plate 41 is secured to the tie beam 300 with nails or the like.

The roof truss is joined to the double plate 400 and to the stud 500 with a strap bolt 40*b*. In this case, the strap bolt 40*b* is passed through the through-holes 31 of the box-shaped anchor loosely fitted over the frame 10 secured to the rear side of the roof truss member 100 through an aperture 401 formed in the ridge 400. The bolt 40*b* is secured with the nut 42 while the fixture plate 41 is secured to the stud 500 such as with nails (FIG. 5).

Figure 6:
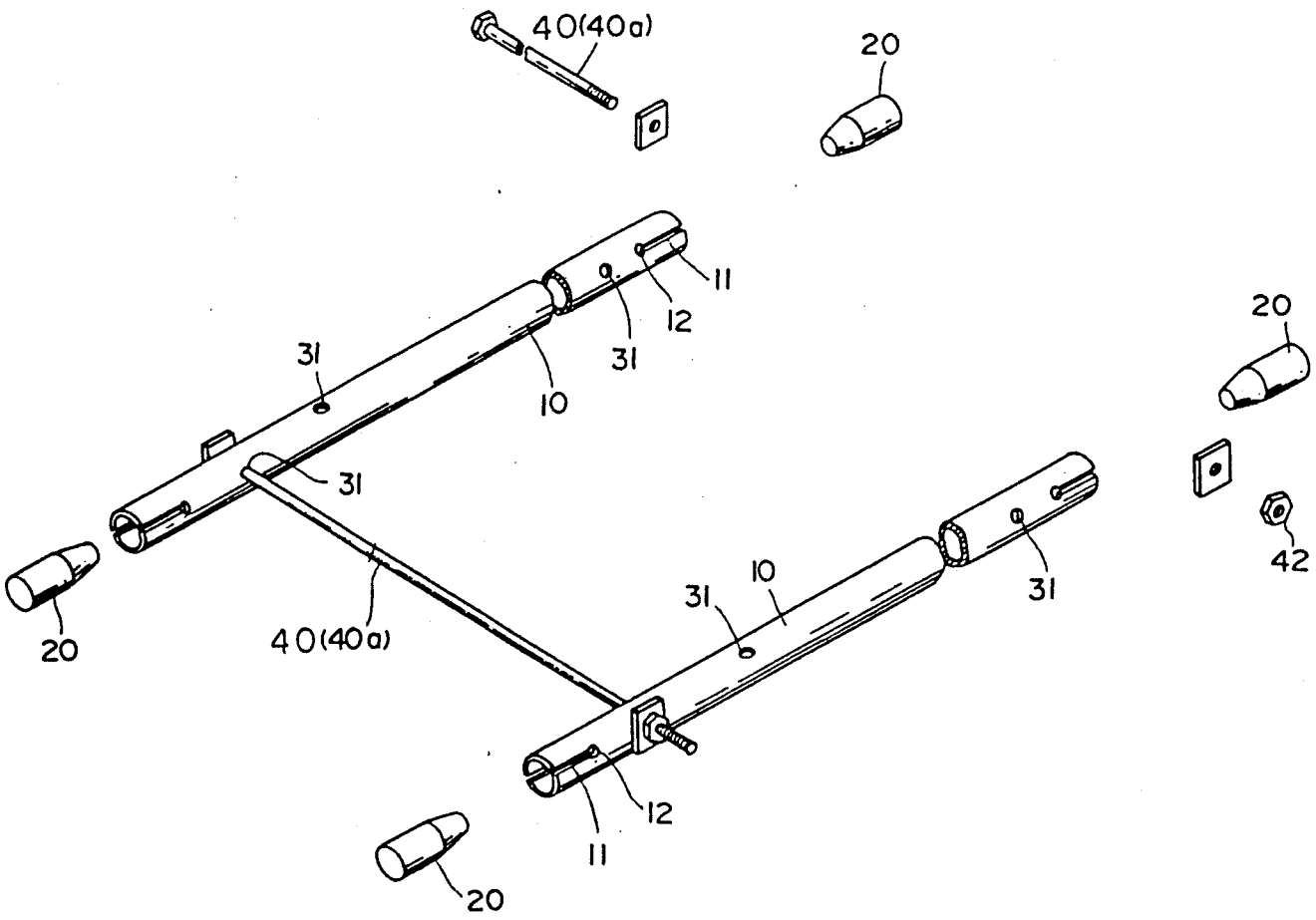
FIG. 6 is a perspective view showing a third embodiment of the invention, with a portion thereof not being shown.

FIG. 6 shows, in a perspective view, a third embodiment of the present invention, with a portion thereof not being shown. In the present embodiment, the box-shaped anchor 30 is not employed, but the through-holes 31 for the connecting member 40 is directly formed in the frame. The through-holes 31 may be provided at any arbitrary position in the frame 10. Hence, with the present embodiment, the metal connector may be markedly simplified.

Meanwhile, the elongated bolt 40*a* in the metal connector of the third embodiment may be employed in place of the strap bolt 40*b* in the same way as in the above described second embodiment. It is noted that the metal connector of the first or the third embodiment may also be used for joining the foundation and wooden members if an anchor bolt is used as the connecting member 40.

With the use of the metal connectors of the present invention, various types of roofs, such as shed roofs, gable roofs, gambrel roofs, M-shaped roofs, saw-toothed roofs or mansard roofs, may be assembled freely.

We claim:

1. A metal connector for a building comprising a frame, a box-shaped anchor loosely fitted over the outer periphery of said frame, a connecting member passed through through-holes in said box-shaped anchor, and wedge members fitted to both ends of said frame, said frame being in the shape of a pipe having a plurality of axial slits at both ends thereof, said box-shaped anchor having a hollow interior having a cross-sectional area larger than the radial cross-section of said frame and being formed with said through-holes for said connecting member in a peripheral wall section thereof.

2. A metal connector for a building as claimed in claim 1 wherein said connecting member is an elongated bolt.

3. A metal connector for a building as claimed in claim 1 wherein said connecting member is a strap bolt having a fixture plate at an end thereof.

4. A metal connector for a building as claimed in claim 1 wherein an aperture is formed at an axially inner end of a slit formed at each end of said frame in contiguity with said slit.

5. A metal connector for a building comprising a frame, a connecting member passed through through-holes in said frame, and wedge members fitted into both ends of said frame, said frame being formed as a pipe a plurality of axial slits being formed at both ends of said pipe, and through-holes for said connecting members being situated axially inwardly of said slits.

6. A metal connector for a building as claimed in claim 5 wherein said connecting member is an elongated bolt.

7. A metal connector for a building as claimed in claim 5 wherein said connecting member is a strap bolt having a fixture plate at an end thereof.

8. A metal connector for a building as claimed in claim 5 wherein an aperture is formed at an axially inner end of a slit formed at each end of said frame in continuity with said slit.

* * * * *